US006341204B1

(12) United States Patent
Tomiki et al.

(10) Patent No.: US 6,341,204 B1
(45) **Date of Patent: *Jan. 22, 2002**

(54) DEVELOPMENT APPARATUS EMPLOYING TONER SUPPLY ROLLER COMPRISING ELECTRICALLY CONDUCTIVE FOAMED MATERIAL LAYER

(75) Inventors: Satoshi Tomiki, Kawasaki; Yoshiaki Kobayashi, Souka, both of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/570,637

(22) Filed: Dec. 11, 1995

(30) Foreign Application Priority Data

Dec. 9, 1994 (JP) ..... 6-330909

(51) Int. Cl.[7] ..... G03G 15/08
(52) U.S. Cl. ..... 399/53; 399/272
(58) Field of Search ..... 355/251, 253, 355/259; 118/657, 658; 399/53, 55, 252, 265, 267, 270, 272, 279, 281, 282, 273, 283

(56) References Cited

U.S. PATENT DOCUMENTS

| | | | | | |
|---|---|---|---|---|---|
| 4,788,570 | A | * | 11/1988 | Ogata et al. | 399/53 |
| 4,903,634 | A | * | 2/1990 | Ono et al. | 399/281 |
| 4,941,019 | A | | 7/1990 | Honda et al. | 355/251 |
| 5,030,996 | A | | 7/1991 | Tajima et al. | 355/246 |
| 5,075,728 | A | | 12/1991 | Kobayashi et al. | 355/260 |
| 5,170,213 | A | * | 12/1992 | Yamaguchi et al. | 355/246 |
| 5,241,343 | A | * | 8/1993 | Nishio | 355/219 |
| 5,287,150 | A | * | 2/1994 | Kinoshita et al. | 355/259 |

FOREIGN PATENT DOCUMENTS

| | | | |
|---|---|---|---|
| JP | 42-23910 | | 8/1967 |
| JP | 62-194272 | * | 8/1987 |
| JP | 05-204562 | | 9/1993 |
| JP | 07-114263 | * | 5/1995 |

* cited by examiner

*Primary Examiner*—Quana M. Grainger

(57) ABSTRACT

A development apparatus includes a toner carrying member for carrying magnetic toner disposed opposed to an image bearing member to form a developing zone: magnetic field generating means in the toner carrying member; a toner supplying rotary member for applying the magnetic toner onto the toner carrying member and stripping the magnetic toner from the toner carrying member, comprising a surface layer of electrically conductive foam material.

10 Claims, 5 Drawing Sheets

DEVELOPMENT APPARATUS EMPLOYING TONER SUPPLY ROLLER COMPRISING ELECTRICALLY CONDUCTIVE FOAMED MATERIAL LAYER

FIELD OF THE INVENTION AND RELATED ART

The present invention relates to a development apparatus, which is employed in an image forming apparatus such as a copying machine, printer, or the like employing the electrophotographic system or the electrostatic recording system, to develop an electrostatic image formed on an image bearing member.

In an image forming apparatus, for example, a copying machine, printer, facsimile, and the like, a latent image is formed on the image bearing member constituted of an electrophotographic photosensitive member, an electrostatic recording member of dielectric material, or the like, and then, the formed latent image is developed by a development apparatus, being visualized as a toner image.

As the development apparatus to be employed in the above image forming apparatus, various development apparatuses used with single component dry developer have been proposed or put to practical use. In any of these development apparatuses, it is extremely difficult to form a thin layer of the single component developer (toner) on the developer carrier member. In recent years, on the other hand, higher degrees of sharpness, resolution, and the like have been demanded, making it imperative to develop better methods for forming a thin layer of the toner, and to develop better apparatuses to be used with such methods. As a result, several solutions have been proposed.

According to one of the proposals, a development sleeve as the developer carrier member, the surface of which is blasted with regular particles to give it a relatively small degree of roughness, is used with a magnetic blade disposed to maintain a predetermined gap between itself and the development sleeve surface, and forms a thin layer of the triboelectrically charged toner on the development sleeve.

Even in the case of the development apparatus described above, when the toner with a smaller particle diameter and a lower melting point is simply employed to improve image quality and to quickly start up the apparatus, such toner is liable to be blocked adjacent to the magnetic blade due to the higher degree of flocculation of such toner, yielding images with nonuniformity, or images with fog, in a high humidity environment. In addition, in a low humidity environment, blotch, that is, a phenomenon in which the toner locally flocculates on the development sleeve due to charge-up, occurs to affect the images.

Japanese Laid-Open Patent Application No. 16736/1988 or the like discloses a countermeasure for the above phenomenon, in which an elastic blade composed of rubber, resin, or metal is placed in contact with the development sleeve, with a light contact pressure, so that the excessive amount of the toner adhering to the development sleeve surface is shaved off to regulate the toner layer thickness at the contact point, thereby forming a triboelectrically and uniformly charged thin layer of the toner, on the development sleeve. As a result, images of preferable quality, that is, images with no aberration or fog, can be produced.

According to another countermeasure, a roller composed of foamed polyurethane containing continuous cells, or a fur brush roller, is placed in contact with the development roller, on the upstream side of the contact point between the magnetic blade and development sleeve, relative to the rotational direction of the development sleeve. As such a roller is rotated, the toner adhering to the development sleeve is oscillated at the contact point between the two components, being rendered easily separable from the development sleeve, and at the same time, being triboelectrically charged. In addition, the other blocked adjacent to the magnetic blade as described above is loosened by the rotation of such a roller, recovering thereby preferable fluidity. As a result, high quality images with no blotch, no aberration, and no fog, can be produced as they are by the elastic blade system.

However, when the above two countermeasures (elastic blade system or contact roller system) are employed to continuously make tens to thousands of copies, the following problems occur toward the end of the continuous copying operation, or during toner replenishment.

[1] Elastic Blade System

As the copying operation continues, flocculated toner, coarse toner, dust, fuzz, and the like, which cannot pass the nip formed between the elastic blade and development sleeve, are accumulated in the nip. As a result, the sleeve surface areas correspondent to the accumulation of this foreign matter fail to be coated with the toner, effecting image aberration, in the form of white streaks, at the corresponding regions of the obtained image.

In particular, when the contact pressure between the elastic blade and development sleeve is relatively high, and at the same time, the melting point of the toner is low, the toner is fused to the blade as the copying operation continues. As a result, the toner is improperly regulated, being formed into a non-uniform layer, by the elastic blade, or the toner is given an insufficient amount of triboelectrical charge, by the elastic blade. Consequently, the produced images suffer from non-uniformity, fog, insufficient density, and the like. These phenomena stand out immediately after the toner is replenished, that is, when fresh toner, which has never been charged, is delivered to the adjacencies of the development roller.

[2] Contact Roller System

As a copying operation continues, the toner is gradually accumulated in the roller (foamed urethane roller containing continuous cells collects the toner through the continuous foams: fur brush roller collects the toner among the fiber strands). Consequently, in the case of the roller comprising a foamed material layer, it is hardened, or its cells are disintegrated as the frequency of its sliding contact with the sleeve increases, and in the case of the fur brush roller, it fatigues. As a result, the roller and the sleeve do not make proper contact, failing to shave the toner layer sufficiently and uniformly. In addition, the roller surface is also covered with the toner; therefore, the amount of the triboelectrical charge given in the nip between the roller and the sleeve is also reduced. Thus, the aforementioned blotches, non-uniform image density, fog, image density loss, and the like, occur. Further, when the contact pressure between the roller and sleeve is excessively increased by the hardening of the roller, the torque for driving the development sleeve may have to be excessively increased.

In addition to the problem related to the aformentioned endurance test in which tens of thousands of copies are made, the elastic blade system has another problem in that the thickness of the toner layer on the sleeve, and the amount of the toner charge, are delicately affected even by the slightest change in the amount of blade invasion to the sleeve, making it extremely difficult to set or stabilize the amount of blade invasion.

As means for solving the above problems, development apparatuses such as those disclosed in Japanese Laid-Open Patent Application No. 204562/1993 have been proposed. According to these proposals, foamed rubber containing independent cells is used as the material for the toner carrier member disposed near the magnetic blade, so that an appropriate amount of the toner is coated on the sleeve while stripping away the residual toner, and a preferable amount of charge is reliably given throughout the entire copying operation in which tens of thousands of copies are made.

Further, the sleeve is given a mirror-like peripheral surface; therefore, the amount of the toner coated on the sleeve can be reliably maintained at a predetermined level.

However, when development apparatuses with the above structure were subjected to an endurance test, in which microparticle toner with a particle diameter of no more than 6 $\mu$m was employed in order to improve the image quality, and one million copies were made in order to confirm the possible image stabilization, the following problems manifested.

Test 1

In this test, the development sleeve was made of SUS, and its peripheral surface was given a mirror finish by buffing. The toner carrier member was constituted of a metallic core, and layer of foamed material containing silicone, which covered the metallic core. The resistance value and hardness of the toner carrier member were $10^{13}$ ohm.cm and 25–35 degrees (Asker C, load: 300 g), respectively. The width of the nip between the toner carrier roller and the sleeve was set at 6.0 mm. Humidity was low. At the beginning of the test, the solid black reflection density was 1.5, and the absolute value of the amount of toner charge on the sleeve was 20 $\mu$c/g. The weight of the toner per unit area of the sleeve surface (hereinafter, M/S) was 1.1 mg/cm$^2$. The ten thousandth copy displayed a solid black reflection density of 1.2, a toner charge of 8 $\mu$c/g, and an M/S of 0.7 mg/cm$^2$, showing signs of deterioration in image density and fog. In order to find the cause for the deterioration, the toner particles of the ten thousandth copy were inspected, discovering that the surface area of each toner particle was reduced as the toner particle was rounded; the toner particles were crushed; and the toner particles were fused together. In other words, the deterioration was caused by the deterioration in the physical properties of the toner.

Also, several white streaks were visible. These white streaks, which extended in the rotational direction of the sleeve, were generated due to the non-adhesion of the toner. The inspection of the toner regulation point confirmed that the locations of the white streaks corresponded to the locations where the fused toner particles flocculated. It was also discovered that the sleeve driving torque had to be increased due to the blocking, which was caused as the toner particles flocculated near the toner regulation point.

Test 2

Also in this test, the development sleeve was made of SUS, and its peripheral surface was given a mirror finish. The resistance value and hardness of the toner carrier member were $10^{12}$ ohm.cm, which is the same as Test 1, and 25–30 degrees (Asker C, load: 300 g), respectively. The width of the nip between the toner carrier roller and the sleeve was set at 1.6 mm. Humidity was low. At the beginning of the test, the solid black reflection density was 1.5, and the absolute value of the amount of toner charge on the sleeve was 20 $\mu$c/g. The M/S of the toner on the sleeve surface was 1.1 mg/cm$^2$. After several thousand copies were made, the solid black reflection density was 1.5, but the toner charge fluctuated within a range of 15–30 $\mu$c/g, and also, the M/S fluctuated in a range of 1.5–2.5 mg/cm$^2$. The inspection of the sleeve surface revealed the occurrence of the blotching phenomenon.

As the copying operation was further continued, image quality deteriorated; blotching, fogging, skipping, and the like occurred. However, the ten thousandth copy still maintained a solid black reflection density range of 1.4–1.5. The inspection of the toner particles at this time revealed that the toner particles still retained substantially the same shapes as their initial shapes. In other words, the toner particles had not been crushed, nor fused together.

In order to find the cause for the above deterioration, the width of the nip between the toner carrier roller and sleeve was set at 3.5 mm. As a result, the occurrence of the toner blotching on the sleeve reduced, but the sleeve drive torque had to be increased, which proved that the above deterioration was caused by the insufficient and non-uniform shaving of the toner.

SUMMARY OF THE INVENTION

Accordingly, a primary object of the present invention is to provide a development apparatus with durable capacity for reliably regulating the amount of the toner coated on the toner carrier member.

Another object of the present invention is to provide a development apparatus capable of triboelectrically charging the toner to a proper potential level.

According to an aspect of the present invention, a development apparatus comprises:

- a magnetic toner carrier member disposed immediately adjacent to an image bearing member to form a development station in conjunction with the image bearing member;
- magnetic field generating means enclosed within said toner carrier member; and
- a rotary toner supply member for coating the magnetic toner on said toner carrier member, as well as stripping it therefrom;
- wherein the surface layer of said rotary toner supply member is composed of electrically conductive foamed material.

These and the objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, the preferred embodiments of the present invention will be described with reference to the appended drawings. In the following descriptions, the present invention is embodied in the form of an electrophotographic image forming apparatus as illustrated in FIG. 5, but the application of the present invention is not limited to the electrophotographic image forming apparatus alone.

Figure 5:
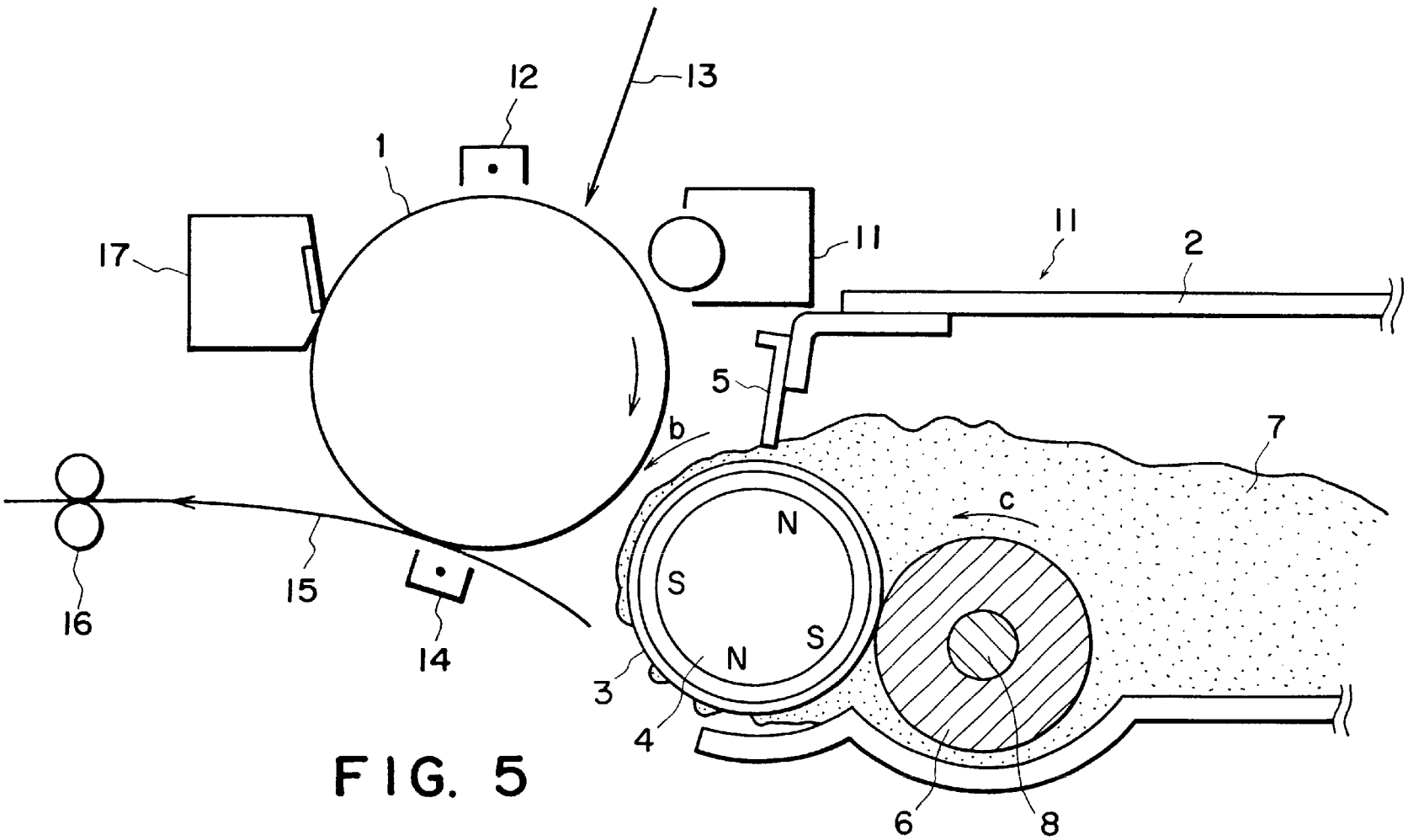
FIG. 5 is a schematic structural view of an embodiment of electrophotographic image forming apparatus in accordance with the present invention.

Referring to FIG. 5, the electro-photographic apparatus comprises, a photosensitive rotary drum 1 as an image bearing member; a primary charger 12, a light emitting element 13 such as a laser, a development apparatus, a transfer charger 14, a fixing apparatus 16, and a cleaning apparatus 17. The photosensitive drum 1 is uniformly charged by the primary charger 12, and then is exposed to the light emitted from the light omitting element 13 in response to image data to form an electrostatic latent image, which is visualized by the development apparatus 11. The visualized image is transferred onto a transfer sheet 15 by the transfer charger 14, and fixed to the transfer sheet 15 by the fixing apparatus 16 to become a permanent image. The post transfer residual toner on the photosensitive drum 1 is removed by the cleaning apparatus 17.

Embodiment 1

Figure 1:
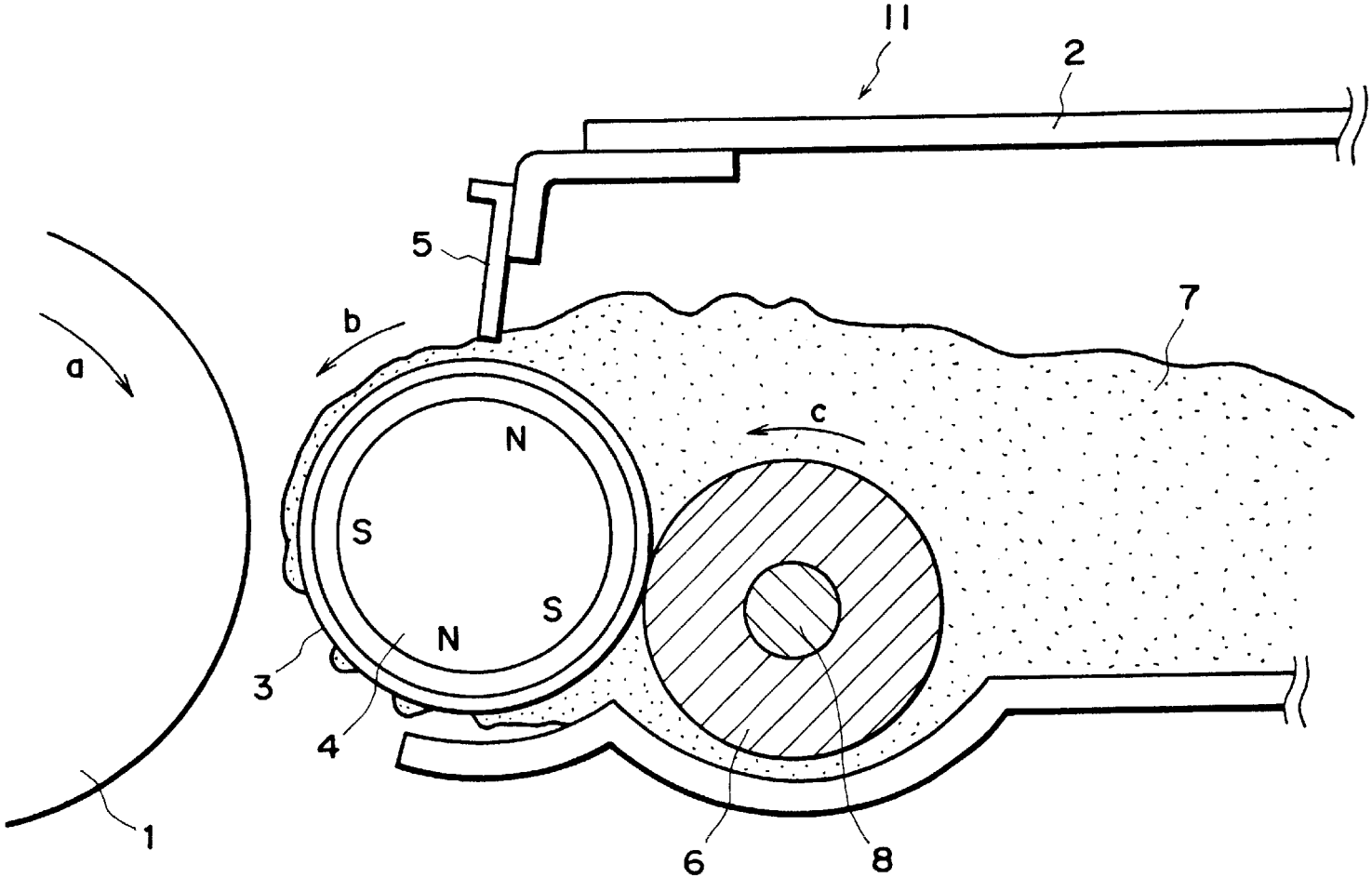
FIG. 1 is a schematic sectional view of the development apparatus in the first embodiment of the present invention.

FIG. 1 is a schematic sectional view of the development apparatus of the image forming apparatus in the first embodiment of the present invention. In the drawing, the development apparatus 11, which is structured to develop the electrostatic latent image on the photosensitive drum 1 into a toner image, comprises a development means container 2. The development means container 2 is disposed adjacent to a photosensitive drum 1 as the image bearing member, which is rotated in the direction of an arrow mark a. The development means container 2 stores magnetic toner 7 as the single component developer, and comprises a development sleeve 3 as the developer carrier member, which contains a magnet 4 as the means for generating a magnetic field. The development sleeve 3 is disposed immediately adjacent to, and in parallel to, the photosensitive drum 1.

The photosensitive drum 1 comprises an electrophotographic photosensitive layer, on the surface of which the electrostatic latent image is formed. This photosensitive layer may be a layer of electrophotographic photoconductor which is used for forming an electrostatic image by the Carlson method, a layer of the dielectric material employed by the NP process, which is disclosed in Japanese Laid-Open Patent Application No. 23910/1967, or a layer of the like material, on which the electrostatic latent image (inclusive of electric potential images) can be formed using an appropriate method.

The development means container 2 has an opening, which extends in the longitudinal direction (direction perpendicular to the surface of the drawing) of the development apparatus 11. The aforementioned development sleeve 3 is disposed in this opening.

The development sleeve 3 is composed of aluminum, SUS or the like, and is rotatively disposed immediately adjacent to, and in parallel to, the photosensitive drum 1, wherein substantially the right half of the peripheral surface of the development sleeve 3, relative to the opening as seen in the drawing, is disposed within the development means container 3, and substantially the left half of it is exposed from the development means container 2. Between the development sleeve 3 and photosensitive drum 1, a microscopic gap is provided. The development sleeve 3 is rotatively driven in the direction of an arrow b, in contrast to the rotational direction a of the photosensitive drum 1. In this embodiment, the development sleeve 3 is formed of SUS, and is given a mirror-like surface to form a thinner toner coat, but the development sleeve 3 may be given a relatively smooth surface with only slight roughness.

The configuration of the development sleeve as the developer carrier member does not need to be cylindrical as the aforementioned development sleeve 3. Instead, it may be in the form of an endless belt which is rotatively driven, or in the form of a rubber roller which is electrically conductive.

The magnet 4 in this embodiment is a permanent magnet, and is fixed within the development sleeve 3, maintaining the same location and attitude; therefore, it generates a stationary magnetic field.

Also in the development means container 2, a magnetic blade 5 as a developer regulator member, and a toner supply roller 6 composed of foamed rubber containing independent cells are disposed. The magnetic blade 5 is above the development sleeve 3, with its edge being placed immediately adjacent to the peripheral surface of the development sleeve 3, and the toner supply roller 6 is on the upstream side of the magnetic blade 5 relative to the rotational direction of the development sleeve 3.

In the development apparatus 11 structured as described above, the toner supply roller 6 is rotated in the direction of an arrow mark c, and the magnetic toner 7 is delivered to the adjacencies of the development sleeve 3 by the rotation of the toner supply roller 6, and the function of the magnetic field generated from the magnet 4 within the development sleeve 3. Then, the magnetic toner 7 is introduced into the nip between the development sleeve 3 and toner supply roller 6, being triboelectrically charged to a proper potential level as it is rubbed against the sleeve 3 and supply roller 6. Consequently, the magnetic toner is adhered to the peripheral surface of the sleeve 3 due to the electrostatic force of the triboelectric charge, and the magnetic force of the magnet within the sleeve 3.

As the development sleeve 3 is rotated, the magnetic toner adhering to the surface of the development sleeve 3 is forced through a magnetic regulative station, that is, a gap formed between the magnetic blade 5 and development sleeve 3, being formed into a thin layer of magnetic toner on the development sleeve 3, and then is delivered to the development station constituted of a microscopic gap formed between the photosensitive drum 1 and development sleeve 3.

In the development station, an oscillating voltage, as a development bias, composed of a DC component and an AC component superposed thereon is applied between the development sleeve 3 and photosensitive drum 1, whereby the magnetic toner 7 on the development sleeve 3 is transferred onto the photosensitive drum 1, being adhered thereto, in such a manner as to reflect the electrostatic latent image on the photosensitive drum 1. As a result, the electrostatic latent image is visualized as a toner image.

As the development sleeve is further rotated, the residual magnetic toner 7, that is, the toner which is delivered to the development station, but is not consumed there for the development, is recovered into the developer means container 2 from the bottom side of the development sleeve 3. As the recovered toner enters the nip between the toner supply roller 6 and development roller 3, it is stripped from the development sleeve 3 by the rotating toner supply roller 6, which at the same time supplies the surface of the development sleeve 3 with a fresh supply of the magnetic toner 7; the fresh supply of the toner is delivered to the adjacencies of the magnetic blade 5 as the development sleeve 3 is rotated. On the other hand, the major portion of the aforementioned stripped toner is mixed with the toner within the development means container 2 as the toner supply roller continues to be rotated. As a result, the charge of the stripped toner is dispersed.

Figure 2:
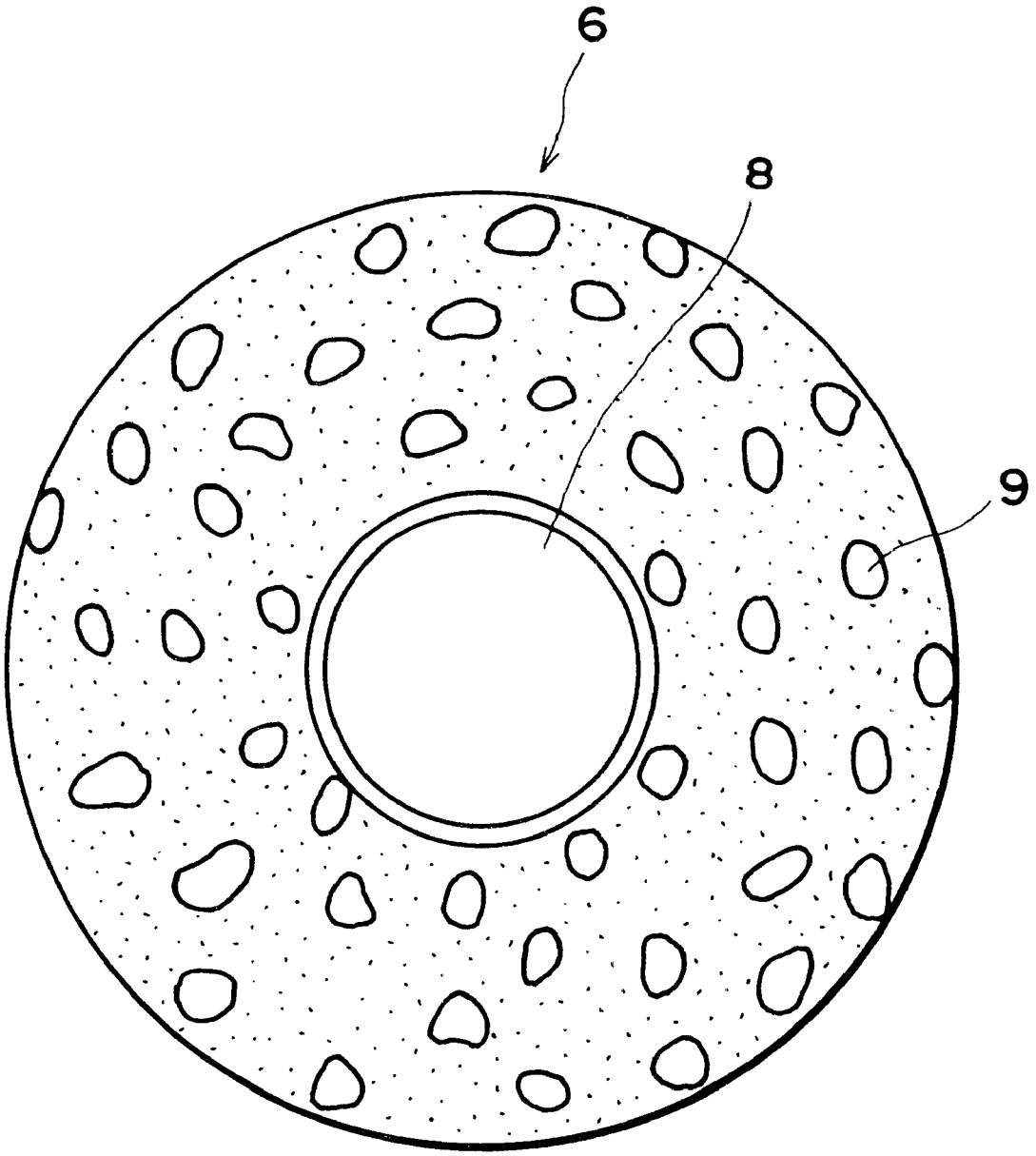
FIG. 2 is a schematic sectional view of the development apparatus in the second embodiment of the present invention.

Next, the toner supply roller of this embodiment will be described in detail. Referring to FIG. 2, which is a schematic sectional view of the toner supply roller in this embodiment, the toner supply roller 2 comprises a metallic core 8 as a supporting shaft, and a roller-like layer of foamed material fitted around the metallic core 8, wherein the foamed material is composed of silicone rubber, EPDM rubber, CR rubber, neoprene rubber, or the like, and contains independent cells 9, that is, cells with a wall surface independent from those of the adjacent cells. The toner supply roller is disposed in contact with the development sleeve 3, and is rotatively driven in the direction of an arrow mark c in FIG. 1, rubbing against the development sleeve 3. This toner supply roller comprising foamed rubber containing independent cells (hereinafter, independent cell foam roller) displays a greater surface density than the conventional rollers such as the rollers containing continuous foams, or the fur brush rollers, and therefor, even when its amount of invasion to the development sleeve 3 is set at the same level as the conventional rollers, the actual contact area between the toner supply roller and development sleeve is increased. As a result, the employment of the toner supply roller of this embodiment enables the toner to be coated on, or stripped from, the development sleeve 3 in a more preferable manner in comparison with the conventional rollers.

The aforementioned independent cell foam roller of this embodiment is formed of independent cell foam material composed of silicone rubber, and carbon black dispersed therein to give electrical conductivity. It is preferred to display the following characteristics.

Volumetric resistivity: $10^4$–$10^9$ ohm.cm$^2$

Density: 0.15–0.35 g/cm$^2$

Hardness: 10–30 degrees (Asker C, load: 300 g)

Surface cell number: 100–100 cells/inch

When the hardness is no more than 10 degrees, low molecular weight oil is liable to ooze out and contaminate the sleeve, and when it is no less than 30 degrees, the contact pressure increases, causing toner fusion on the sleeve, and necessitating driving torque increase. The ranges for the density and surface cell number are also set due to the same reason.

When the volumetric resistivity of the foam material is not in the range of $10^4$–$10^9$ ohm.cm$^2$, the charge, which is generated on the toner as the toner is stripped away from the development sleeve, can be properly dispersed through the toner supply roller 6, weakening the electrostatic force of the charge; therefore, the toner can be more effectively stripped from the development sleeve 3, and also, the abnormal charge-up of the toner can be prevented. Consequently, the abnormal coating of the development sleeve such as blotching is prevented. At the same time, the toner is triboelectrically charged to a proper potential level as the toner supply roller 6 and development sleeve 3 rub each other; therefore, the toner is sufficiently adhered to the surface of the development sleeve 3.

In this embodiment, the toner supply roller 6 comprised the metallic core and the roller-like surface layer of the independent cell foam material. The external diameter of the metallic core was 6 mm. The roller-like surface layer was formed of foamed silicone rubber containing independent cells, and carbon black dispersed therein. The surface layer was 20 degrees in hardness (Asker C, load: 300 g), 0.25 g/cm$^3$ in density, 200 cells/inch in cell number, $10^5$–$10^6$ ohm.cm$^2$ in resistivity, 4 mm in thickness, and 14 mm in external diameter. The toner supply roller 6 was rotated in the same rotational direction as the development sleeve 3 (counter direction at the rubbing point) at a constant speed, and copies were made in a low humidity environment, using the contact nip widths of 0.0 mm, 0.5 mm, 1.0 mm, 1.5 mm and 2.0 mm.

The magnetic toner 7 is a single component developer, and is composed of thermal plastic resin such as styrene resin, acrylic resin, polyethylene resin, or the like, and magnetic material such as ferrite dispersed therein. In this embodiment, the magnetic toner was composed of styrene-acrylic copolymer resin, styrene-butadiene copolymer resin, and magnetic material. Its average particle diameter was 6 $\mu$m. Further, colloidal silica was added to the toner by 0.6%. It was chargeable to negative polarity.

The development apparatus structured as described above was assembled into a copying machine (Canon GP-55). As for the bias voltage, an oscillating voltage composed of a DC component, and an AC component superposed thereon, was used. The voltage of the DC component was −550V. The frequency and peak-to-peak voltage of the superposed AC component were 2,000 Hz and 1,400V, respectively. The surface potential of the latent image on the photosensitive drum 1 was set at −700V for the light spots, and at −250V for the dark spots. The gap between the development sleeve 3 and photosensitive drum 1 was set at 300 $\mu$m. The employed development method was a noncontact reverse development method.

In a comparison test, a toner supply roller with substantially the same characteristics as the toner supply roller of the first embodiment, except for the resistance value range of the independent cell foam material, which was changed to a range of $10^{12}$–$10^{13}$ ohm.cm$^2$, was used to carry out the same image forming operation, in the same low humidity environment, using the same contact nip widths, as the first embodiment.

The results of the first embodiment and comparison test are given in Table 1.

TABLE 1

| | Contact width | Formed images |
|---|---|---|
| Embodiment $10^5$–$10^6$ ohm.cm | 2.0 | No unevenness, No blotch, No deterioration up to 1,000,000 sheets |
| | 1.5 | No unevenness, No blotch, No deterioration up to 1,000,000 sheets |
| | 1.0 | No unevenness, No blotch, No deterioration up to 1,000,000 sheets |
| | 0.5 | No unevenness, No blotch, No deterioration up to 1,000,000 sheets |
| | 0.0 | No unevenness, No blotch, No deterioration up to 1,000,000 sheets |
| Comp. $10^{12}$–$10^{13}$ ohm.cm | 2.0 | Unevenness in coating and image density at 500 sheets |
| | 1.5 | Unevenness in coating at 1000 sheets, blotch at 3000 sheets and density unevenness at 5000 sheets |
| | 1.0 | Blotch at 1000 sheets, and density unevenness at 2000 sheets |
| | 0.5 | Blotch at 500 sheets, and density unevenness at 800 sheets |
| | 0.0 | Blotch at 100 sheets, and density uneveness at 200 sheets |

In the comparison test, the contact nip width of no more than 1.5 mm caused the blotching, and even the contact width of 2.0 mm caused the toner layer to be non-uniformly formed on the development sleeve 3. In contrast, according to the present invention, a uniform layer of a preferable thickness could be formed on the development sleeve 3, and the level of the toner charge was stable at 18–20 $\mu$c/g.

In this embodiment, in which one million copies were continuously made, replenishing the toner for every 3,000 copies, preferable image quality could be maintained, that is, images with no density aberration, no fog, and no density deterioration could be obtained, from the beginning of the operation until the last copy was made, including the periods before and after the toner replenishment.

Further, according to the present invention, the excessive charge of the charged-up toner is dispersed, preventing the toner adhering to the surface of the development sleeve 3 from being charged up by the toner supply roller 6, and consequently, preventing the toner from flocculating. Therefore, the adhesion of the flocculated toner to the blade, which relatively easily occurs in the magnetic blade system, does not occur. Thus, it is not liable that the toner is nonuniformly coated on the development sleeve 3 in the circumferential direction of the development sleeve 3 due to the adhesion of the flocculated toner to the blade member.

Also, according to the present invention, even when the contact nip width is set in a range of 0.1–2.0 mm, the coating irregularity, and the resultant blotched image do not occur. Further, it is unnecessary to increase the driving torque for the development sleeve 3, and it is possible to prevent the deterioration of the physical properties of the toner.

From the standpoint of the deterioration of the physical properties of the toner, the contact nip width is preferable to be in a range of 0.0–5.0 mm, more preferably, in a range of 0.0–2.0 mm.

The development method in this embodiment was a reverse development method, but it is obvious that the present invention is also applicable to the regular development method.

Further, the toner supply roller in this embodiment was a roller with a single layer of electrically conductive material. But the toner supply roller may comprise multiple layers, for example, two layers. When the toner supply roller comprises multiple layers, the topmost layer is composed of the electrically conductive foam material containing independent cells, and the under layers provide elasticity. As a result, the abnormal charge-up up of the toner is prevented; the hardness of the roller is prevented from becoming excessive; the durability of the roller is improved; and the deterioration of the physical properties of toner is prevented.

The electrically conductive foamed material in this embodiment was composed of silicone rubber, and carbon black dispersed therein as the agent for providing electrical conductivity. But, a different rubber and a different conductive material may be employed in place of the silicone rubber and the carbon black, respectively.

Embodiment 2

Figure 3:
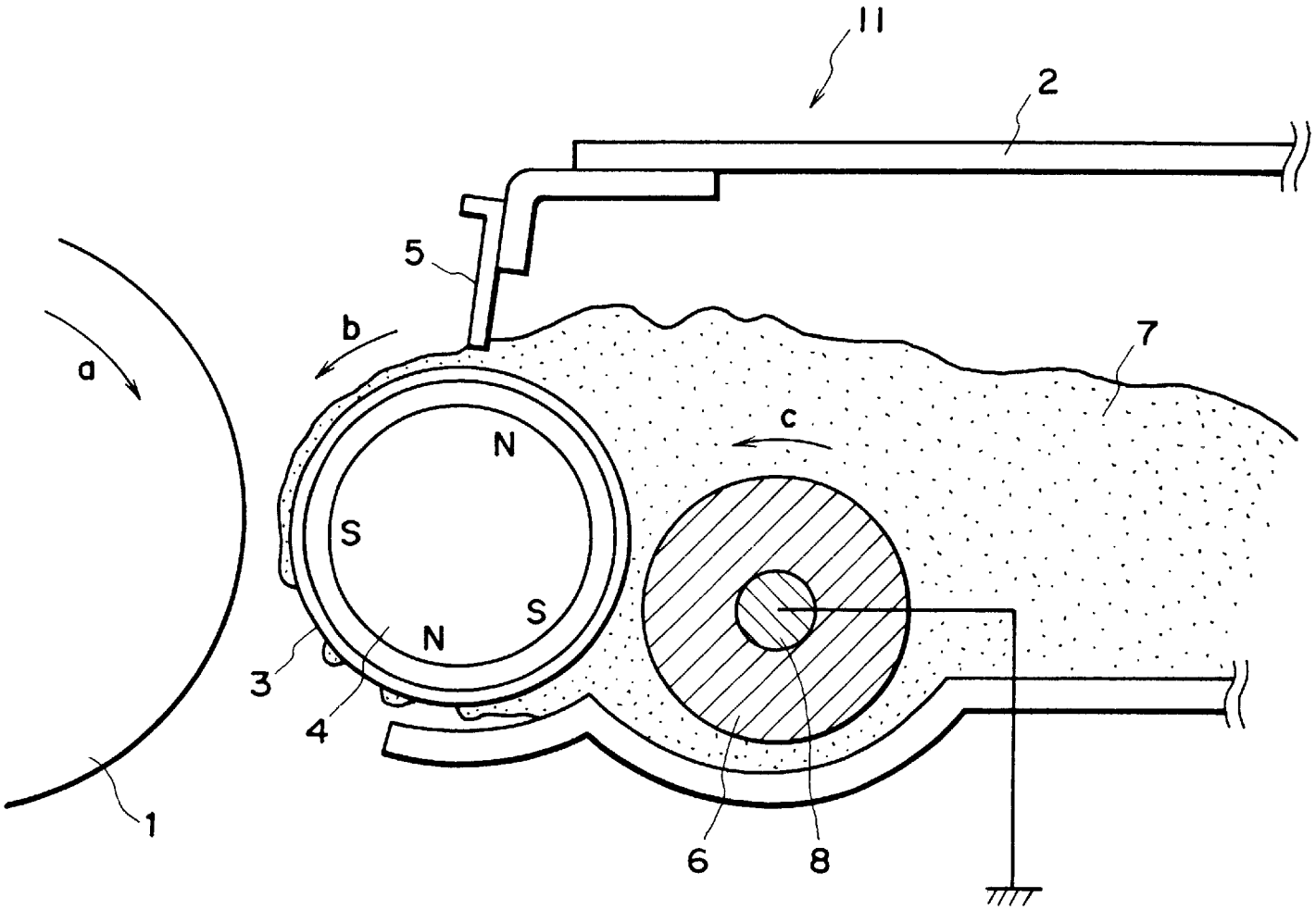
FIG. 3 is a schematic sectional view of the development apparatus in the third embodiment of the present invention.

Next, the second embodiment of the present invention will be described. FIG. 3 is a schematic sectional view of the development apparatus in the second embodiment of the present invention. Also in this embodiment, the reverse development was employed as it was in the first embodiment. The structural components in FIG. 3 are the same as those employed in the first embodiment; therefore, their descriptions will be omitted.

In this embodiment, the toner supply roller 6 is placed adjacent to, but not in contact with, the development sleeve 3, and the metallic core 8 is grounded.

The development apparatus structured as described above was assembled into a copying machine (Canon GP-55). As for the bias voltage, an oscillating voltage composed of a DC component, and an AC component superposed thereon, was used. The voltage of the DC component was −550V. The frequency and peak-to-peak voltage of the superposed AC component were 2,000 Hz and 1,400V, respectively. The surface potential of the latent image on the photosensitive drum 1 as set at −700V for the light spots, and at −250V for the dark spots. The gap between the development sleeve 3 and photosensitive drum 1 was set at 300 μm. The employed development method was a noncontact reverse development method.

In this embodiment, the minimum gap between the development sleeve 3 and toner supply roller 6 was set at 300 μm; therefore, the maximum strength of the electric field generated between the development sleeve 3 and toner supply roller 6 was:

$$[550V+700V]\approx 3.3\times 10^6[V/m].$$

In this embodiment, the toner to be recovered into the development means container 2 was recovered from the bottom portion of the development sleeve 3 as the development sleeve 3 was rotated; the residual toner on the development sleeve 3 was stripped away from the development sleeve due to the difference in the potential level (electric field), in the adjacencies of the point at which the gap between the development sleeve 3 and toner supply roller 6 was minimum. The spots on the development sleeve 3, from which the toner was stripped, were covered with a fresh supply of toner, and then, the toner adhering to the toner supply roller 6 was delivered to the adjacencies of the magnetic blade 5. The toner supply roller 6 is rotated in the same rotational direction as the development sleeve 3, at a constant speed.

Also in this embodiment, a uniform layer of a preferable thickness for the reverse development could be formed, and maintained, on the development sleeve 3. Further, since the toner supply roller 6 was not in contact with the development sleeve 3, the driving torque increase, which would be required if the sleeve and roller were in contact with each other, was unnecessary, and no toner deterioration occurred, in other words, according to this embodiment, the object of the present invention was accomplished by a simple structure, that is, the grounding of the toner supply roller 6.

In this embodiment, in order to maintain a predetermined distance between the development sleeve 3 and toner supply roller 6, a spacer ring was provided at both ends of the toner supply roller 6. The minimum distance between the development sleeve 3 and toner supply roller 6 in this embodiment was set at 300 μm, but additional experiments, in which the off-center position of the roller, the wobbing of the roller, the leak to the development sleeve 3 due to the surface properties (edge surface maintenance), the strength of the electric field necessary for stripping the toner, and the like factors, were taken into consideration, revealed that a distance range of 200 μm to 500 μm was preferable.

Embodiment 3

Figure 4:
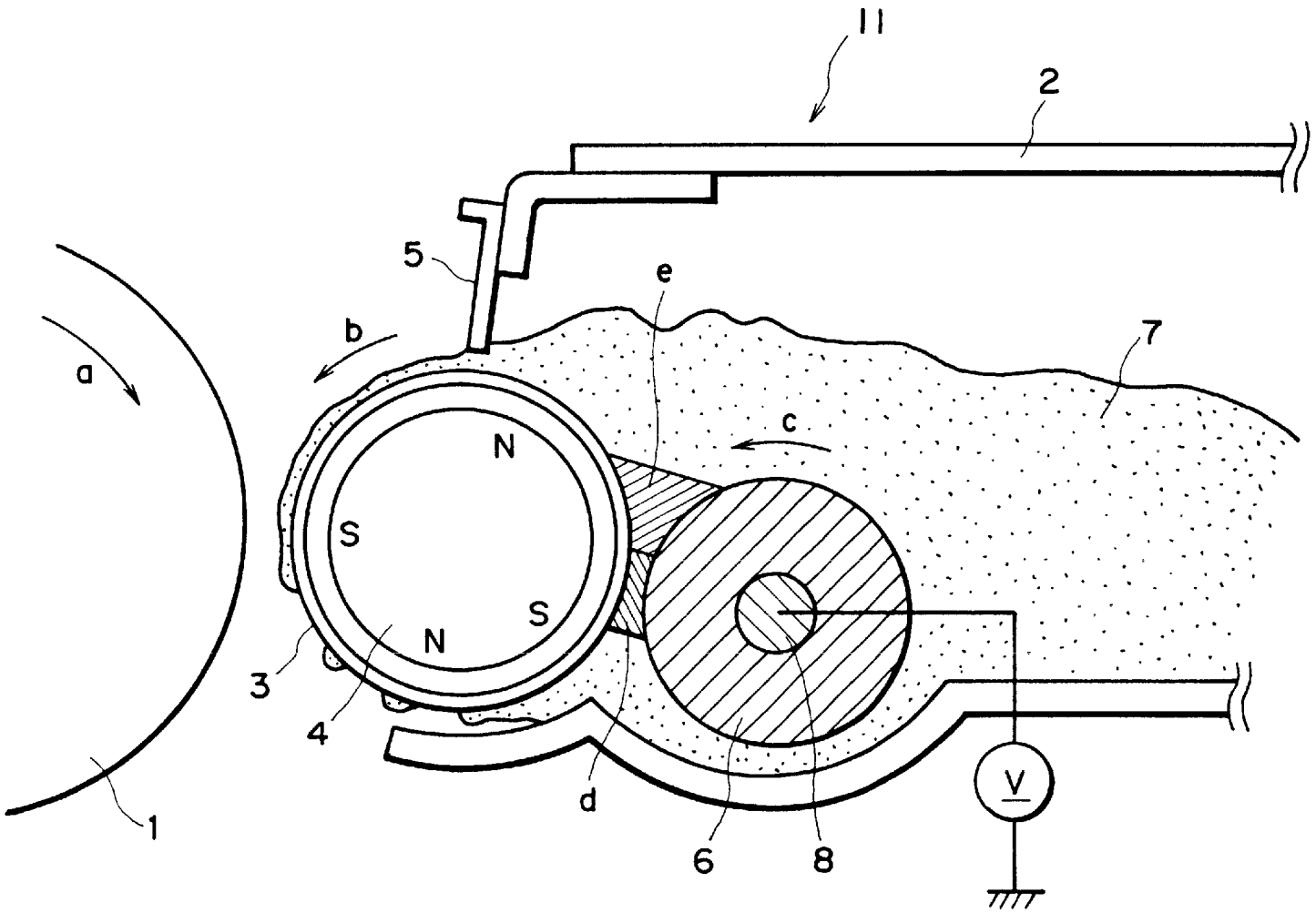
FIG. 4 is an enlarged sectional view of the toner supply roller of the development apparatus illustrate din FIG. 1.

Next, the third embodiment of the present invention will be described. FIG. 4 is a schematic sectional view of the development apparatus in the third embodiment of the present invention.

In this embodiment, the toner supply roller 6 was disposed adjacent to, but no in contact with, the development sleeve 3, and a DC bias was applied to the metallic core 8.

With the application of the DC bias, the maximum strength of the electric field between the development sleeve 3 and toner supply roller 3 could be adjusted to a desirable value.

The minimum distance between the development sleeve 3 and toner supply roller 6 was set at 300 μm, and a bias of −250V was applied to substantially equalize the maximum strength of the electric field on the surface of the development sleeve 3 to that of the photosensitive drum 1, during the formation of a solid black image.

The development apparatus structured as described above was assembled into a copying machine (Canon GP-55). As for the bias voltage, an oscillating voltage composed of a DC component, and an AC component superposed thereon, was used. The voltage of the DC component was −550V. The frequency and peak-to-peak voltage of the superposed AC component were 2,000 Hz and 1,400V, respectively. The surface potential of the latent image on the photosensitive drum 1 was set at −700V for the light spots, and at −250V for the dark spots. The gap between the development sleeve 3 and photosensitive drum 1 was set at 300 $\mu$m. The employed development method was a non-contact reverse development method.

The rotational direction of the toner supply roller 3 was the same as that of the development sleeve 3 (counter direction at the point where the two components are closest to each other). The peripheral velocity of the toner supply roller 3 was 1.5 times that of the development sleeve 3.

With the employment of the above structure, the effect of the electric field generated between the development sleeve 3 and toner supply roller 6, that is, the toner stripping capacity of the electric field, is concentrated to the adjacencies of the point where the distance between the development sleeve 3 and toner supply roller 6 is minimum, that is, the region where the toner stripping capacity is preferably concentrated (region d) to strip the toner. As the residual toner on the development sleeve 3 is moved into the adjacencies of the minimum gap point by the rotation of the development sleeve 3, it is stripped, and as the development sleeve 3 is further rotated, a fresh supply of toner is delivered to the surface of the development sleeve 3, on the downstream side (region c) of the minimum gap point, by the pressure generated by the rotation of the toner supply roller 6. While being delivered, the toner particles are triboelectrically charged due to the friction among them. Consequently, the fresh supply of toner is adhered to the surface of the development sleeve 3 by the combination of the electrostatic force from the toner charge, and the magnetic force from the magnet 4 within the development sleeve 3. In this embodiment, the peripheral velocity of the toner supply roller 6 was set at approximately 1.5 times that of the development sleeve 3 to increase the pressure applied to the fresh supply of toner by the rotation of the toner supply roller 6.

According to this embodiment, the effects created by the electric field for striping the residual toner from the surface of the development sleeve 3, and for adhering the fresh supply of toner thereto, are well balanced by applying a predetermined DC bias. As a result, the toner is always delivered to, and adhered to, the surface of the development roller 3, by an amount sufficient even for the formation of solid black images or the like, so that high quality images can be reliably formed.

In this embodiment, the development sleeve 3 was given a mirror-like peripheral surface, but the development sleeve may be given a relatively smooth surface with slight irregularity to improve the toner delivery capacity. Further, in this embodiment, the images were formed through the image exposure process and reverse development process, but it is obvious that even when the background exposure process and normal development process are employed, the same effects as this embodiment can be obtained by the application of a predetermined DC bias.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus comprising:

a toner carrying member for carrying a magnetic toner disposed in opposing relation to an image bearing member to form a developing zone;

a magnetic member having a plurality of magnetic poles in said toner carrying member;

a toner supplying rotary member for applying the toner onto said toner carrying member and stripping the toner from said toner carrying member, said toner supplying rotary member comprising a surface layer of electrically conductive foam material, wherein said toner supplying rotary member effects application and stripping of the toner at a position between the magnetic poles; and grounding means for electrically grounding the surface layer, said grounding means being effective to remove an electric charge, which the surface layer receives when the toner is stripped off said toner carrying member.

2. A developing apparatus according to claim 1, wherein said toner supplying rotary member is disposed with a gap between itself and said toner carrying member.

3. A developing apparatus according to claim 1, wherein said electrically conductive foam material contains independent cells.

4. A developing apparatus according to claim 3, wherein the contact width between said toner supplying rotary member and toner carrying member is 0.0–5.0 mm; the foamed material has a density of 0.15–0.35 g/cm$^3$ and a hardness of 10–30 degrees in Asker C scale (load: 300 g); and the number of cells is 100–400 cells/inch.

5. A developing apparatus according to claim 1, wherein the volume resistance of said foamed material is $10^4$–$10^9$ ohm.cm.

6. A developing apparatus according to claim 1, wherein said toner carrying member is given a mirror-finish peripheral surface.

7. A developing apparatus according to claim 1, wherein the surface of said toner carrying member is roughened.

8. A developing apparatus according to claim 1, wherein said developing apparatus employs a reverse development process to develop an electrostatic image formed on said image bearing member.

9. A developing apparatus according to claim 8, wherein said toner supplying rotary member has an electrically grounded core metal, and the electrically conductive foam material is provided on said core metal.

10. An apparatus according to claim 1, wherein said toner supplying rotary member rotates in the same rotational direction as said toner carrying member.

* * * * *

UNITED STATES PATENT AND TRADEMARK OFFICE

CERTIFICATE OF CORRECTION

PATENT NO. : 6,341,204 B1
DATED : January 22, 2002
INVENTOR(S) : Satoshi Tomiki et al.

It is certified that error appears in the above-identified patent and that said Letters Patent is hereby corrected as shown below:

Title page,
Item [57], ABSTRACT,
Line 3, "zone:" should read -- zone; --; and
Line 4, "a" should read -- and a --.
Item [74], insert -- [74] *Agent, Attorney, or Firm* - Fitzpatrick, Cella, Harper & Scinto --.

Column 2,
Line 42, "foams:" should read -- foams; -- and
Line 58, "aformentioned" should read -- aforementioned --.

Column 4,
Line 56, "illustrate din" should read -- illustrated in --.

Column 5,
Line 4, "comprises," should read -- comprises --;
Line 5, "member;" should read -- member, --;
Line 10, "omitting" should read -- emitting --; and
Line 58, "container 3," should read -- container 2, --.

Column 6,
Line 57, "roller 3," should read -- sleeve 3, --.

Column 7,
Line 4, "roller 2" should read -- roller 6 --; and
Line 35, "100-100" should read -- 100-400 --.

Column 10,
Line 3, "as" should read -- was --;
Line 36, "occurred," should read -- occurred. --;
Line 37, "in" should read -- In --;
Line 46, "wobbing" should read -- wobbling --;
Line 58, "no" should read -- not --; and
Line 62, "roller 3" should read -- roller 6 --.

UNITED STATES PATENT AND TRADEMARK OFFICE

CERTIFICATE OF CORRECTION

PATENT NO. : 6,341,204 B1
DATED : January 22, 2002
INVENTOR(S) : Satoshi Tomiki et al.

It is certified that error appears in the above-identified patent and that said Letters Patent is hereby corrected as shown below:

Column 11,
Line 16, "roller 3" should read -- roller 6 --;
Line 20, "roller 3" should read -- roller 6 --; and
Line 53, "roller 3," should read -- sleeve 3, --.

Column 12,
Line 38, "foamed" should read -- foam --; and
Line 43, "foamed" should read -- foam --.

Signed and Sealed this

Sixteenth Day of July, 2002

*Attest:*

*Attesting Officer*

JAMES E. ROGAN
*Director of the United States Patent and Trademark Office*